United States Patent [19]

Graves et al.

[11] 4,208,603

[45] Jun. 17, 1980

[54] ELECTRIC LAMP HAVING IMPROVED INLEAD CONSTRUCTION

[75] Inventors: James A. Graves, Euclid; Francis W. Pikus, Cleveland Heights, both of Ohio

[73] Assignee: General Electric Company, Schenectady, N.Y.

[21] Appl. No.: 10,363

[22] Filed: Feb. 8, 1979

[51] Int. Cl.[2] ..... H01J 61/96; H01K 1/20

[52] U.S. Cl. ..... 313/1; 313/333; 313/272; 313/273; 313/316

[58] Field of Search ..... 313/331, 332, 333, 272, 313/273, 316, 1

[56] References Cited

U.S. PATENT DOCUMENTS

| | | | |
|---|---|---|---|
| 2,716,714 | 8/1955 | Adams et al. | 313/332 X |
| 3,148,305 | 9/1964 | Pearson | 315/51 |
| 4,131,819 | 12/1979 | Graves | 313/331 |
| 4,138,623 | 2/1979 | McMillan | 313/331 |
| 4,151,445 | 4/1979 | Davenport et al. | 315/92 |

*Primary Examiner*—Alfred E. Smith
*Assistant Examiner*—Charles F. Roberts
*Attorney, Agent, or Firm*—John F. McDevitt; Lawrence R. Kempton; Philip L. Schlamp

[57] ABSTRACT

An electric lamp construction is described having a pair of conductive inlead wires of dispersion-strengthened copper alloy to serve as the sole means of physical support for a resistive incandescent filament electrically connected thereto, wherein said inlead wires have a surface metallurgical structure of fibrous dispersion-strengthened copper alloy. Said metallurgical surface of the inlead wires can further serve to enhance bonding of other materials thereto including metals such as nickel and aluminum as well as nonmetallic gettering materials such as phosphorous compounds.

25 Claims, 7 Drawing Figures

Fig. 1
PRIOR ART
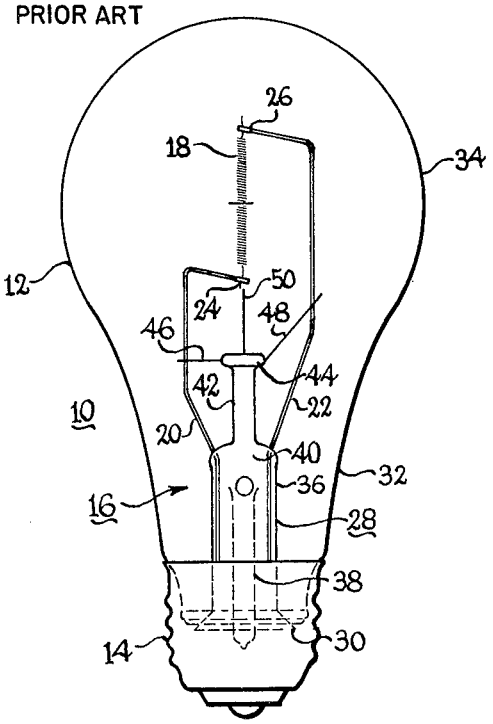
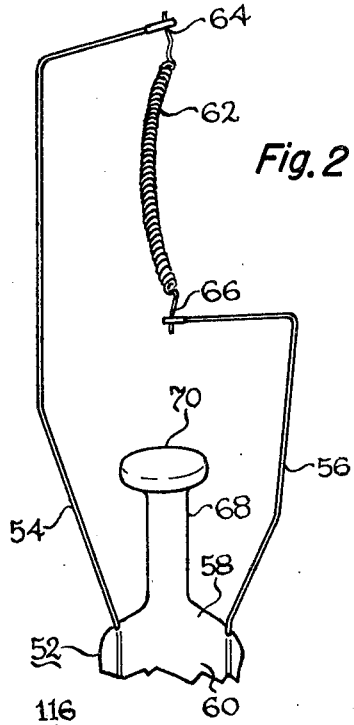
Fig. 2
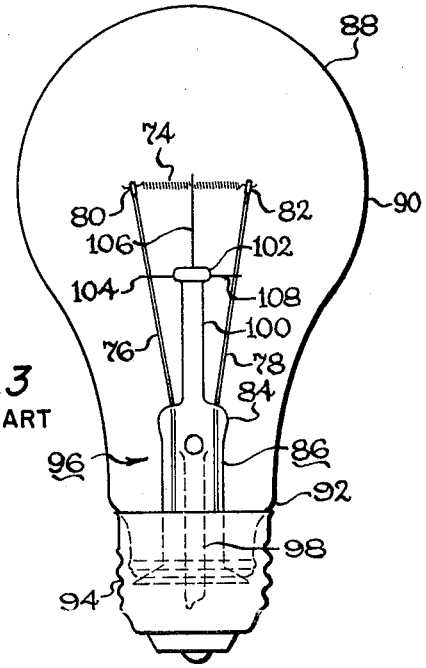
Fig. 3
PRIOR ART
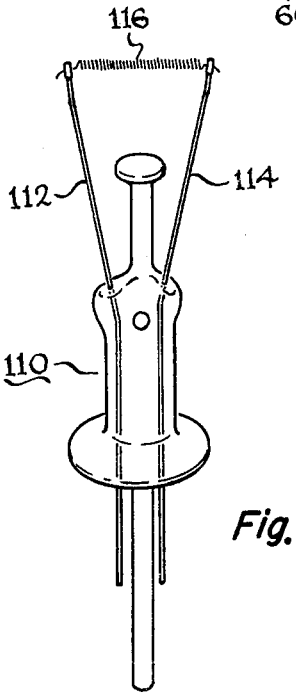
Fig. 4

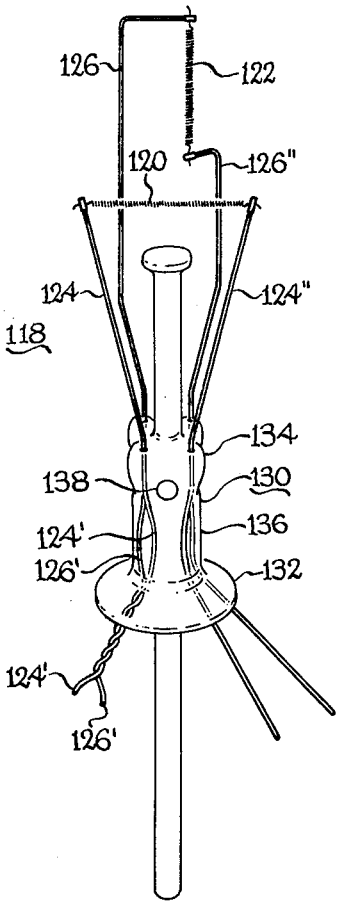
Fig. 5
Fig. 6
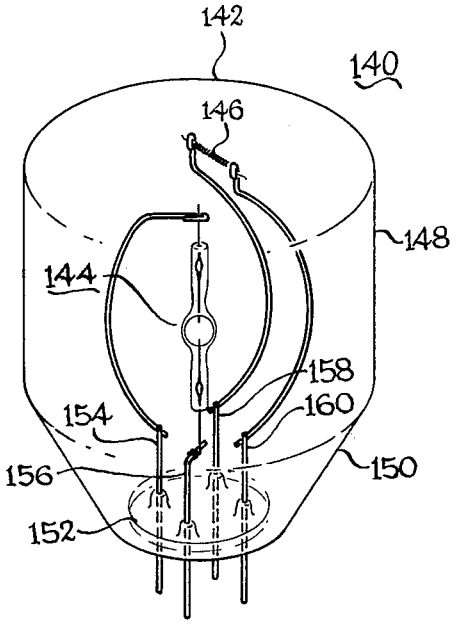

ELECTRIC LAMP HAVING IMPROVED INLEAD CONSTRUCTION

REFERENCE TO RELATED PATENT APPLICATION

An electric lamp of the incandescent type utilizing inlead wires of dispersion strengthened copper alloy is described in U.S. Pat. Appl. Ser. No. 889,265, filed Mar. 23, 1978, now U.S. Pat. No. 4,138,623, in the name of John McMillan and assigned the assignee of the present invention. As disclosed in said patent application, the specific dispersion-strengthened copper alloy materials found useful are said to be GlidCop AL20 and GTE Sylvania material DSC 200, with both of said materials in wire form having an outer surface portion or sheath of the copper matrix metal which is attributable to the manner in which the wire product is manufactured. As further disclosed in said patent application, said dispersion-strengthened copper alloy lead wires eliminate the need for additional structural support of the resistive incandescent lamp filament and said lead wires can be nickel-plated as the means of reducing contaminant release from the underlying copper sheath during lamp operation.

BACKGROUND OF THE INVENTION

An electric lamp having a lead wire construction of improved stiffness sufficient to eliminate the need for additional support of the incandescent filament is disclosed in U.S. Pat. No. 4,131,819, also assigned to the present assignee. In said issued patent, the inlead wires are said to exhibit a stiffness value within the range of approximately 300–500 in order to eliminate using tie wires in the lamp without sacrificing the further need of shock resistance. The improved lamp construction illustrated therein includes a specific mount construction for hermetic sealing of the inleads to the outer glass envelope of the lamp in the form of an outer hollow glass tube having flare portion for sealing to the glass envelope which further includes an inner exhaust tube also generally of glass material. The illustrated lamp embodiment still further includes suspension of the resistive incandescent filament by the inleads alone in a transverse direction with respect to the longitudinal direction of said wires and which is customarily termed a CC6 mount orientation of said filament. A different filament orientation is also known although not specifically illustrated in said patent wherein the longitudinal direction of said filament is aligned in the same direction as the longitudinal direction of the inlead wires and with said arrangement being termed a CC8 mount construction.

Use of the commercially available dispersion-strengthened copper alloy inlead wire occasions embrittlement of a tungsten lamp filament when said inleads are nickel-plated in the customary manner. Specifically, this serious problem causing premature lamp failure occurs when nickel migrates to the tungsten filament generally from a location near the point of interconnection between the supporting inleads and the filament. While this cause of filament brittleness has been encountered previously in incandescent lamps utilizing other nickel-plated copper alloys, the lamp failures experienced when dispersion-strengthened copper inleads are nickel-plated to provide the sole structural support for the lamp filament are considerably more frequent. It has thereby not been possible to realize the full benefits in lamp construction from a substitution of dispersion-strengthened copper alloys as the inlead material since the customary nickel-plating of this material results in unreliable lamp performance.

SUMMARY OF THE INVENTION

It has now been discovered, surprisingly, that inlead wires of dispersion-strengthened copper alloys which are devoid of said exterior surface portion of copper matrix metal, as now commercially manufactured, can thereafter be nickel-plated in the customary manner for use in the above improved filament support construction without causing increased filament brittleness. Specifically, absence of said copper metal sheath either resulting from its removal by such conventional techniques as scarfing and the like or resulting from a mode of preparation for said dispersion-strengthened copper alloy wire which does not produce a residual copper metal sheath permits superior bonding thereafter of a nickel deposit to the copper alloy surface which is not as prone to migration during lamp operation. While the exact mechanism for such improved bondability to the surface metallurgical structure of dispersion-strengthened copper alloys is still unknown at this time, it is believed to be attributable to a fibrous microstructure in said alloy materials which resists recrystallization at temperatures close to the alloy melting points. By reason of said fibrous surface structure, it is further believed that both metals and nonmetals which are in physical contact with such surface to serve as either a protective barrier or provide gettering in the lamp can better diffuse or otherwise penetrate the fibrous surface without a loss therefrom during the lamp operation. Absence of said copper sheath has also been found not to significantly reduce the mechanical strength of these copper alloys at lamp operating temperatures as will be explained hereinafter in greater detail.

In view of the foregoing, it is therefore the primary object of the present invention to provide an improved electric lamp which contains a resistive incandescent filament electrically connected to a pair of conductive inlead wires of dispersion-strengthened copper alloy serving as a sole means of physical support for said resistive incandescent filament, wherein said inlead wires have a surface metallurgical structure of fibrous dispersion-strengthened alloy.

Another important object of the invention is to provide an electric lamp of the above type construction wherein said inleads have an exterior surface portion of nickel and wherein said exterior nickel surface portion can either be in the form of a deposited layer such as now obtained by electrodeposition or other conventional techniques as well as a residual nickel layer formed during the wire manufacture.

Still other important objects and advantages of the present invention will be apparent from the hereinafter provided detailed description which includes various electric lamp configurations utilizing the same improved inlead construction for support of one or more resistive incandescent filaments providing illumination sources in said lamps.

BRIEF DESCRIPTION OF THE DRAWINGS

FIG. 1 depicts in cross-section one type prior art incandescent lamp.

FIG. 2 illustrates a substitute mount configuration for the incandescent lamp in FIG. 1 which is made in accordance with the present invention.

FIG. 3 depicts in cross section a different type prior art incandescent lamp with respect to the filament mount construction.

FIG. 4 depicts a filament mount construction for the incandescent lamp in FIG. 3 made in accordance with the present invention.

FIG. 5 illustrates a multi-filament mount construction for incandescent-type electric lamps adapted to operate at different levels of illumination and with said mount construction being made in accordance with the present invention.

FIG. 6 depicts still a different type electric lamp having both an inner sealed arc tube and a resistive incandescent lamp filament to serve as separate illumination sources and with the inlead supports for both illumination sources being made in accordance with the present invention.

DETAILED DESCRIPTION OF THE PRESENT INVENTION

Figure 7:
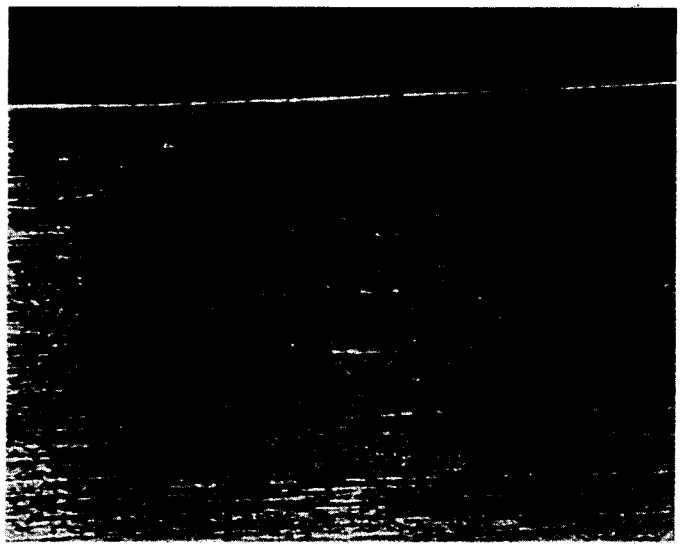
FIG. 7 is a microstructure photograph depicting the fibrous metallurgical structure of the present dispersion-strengthened copper alloy which further includes an exterior surface layer of nickel.

Referring to FIG. 1, there is shown in cross section a conventional incandescent lamp 10 having a transparent envelope 12 which is secured to a base member 14 to provide a housing assembly for a mount construction 16 supporting the resistive incandescent filament 18 that serves as the illumination source in said lamp. An inert gas or vacuum (not shown) is further provided within the sealed transparent envelope, conventionally made of glass, to protect against filament oxidation during lamp operation and the filament material is generally tungsten or some other suitable refractory metal including alloys thereof. For the purposes of this invention, the term "transparent" being used to characterize the lamp envelope signifies ability to transmit visible light and conventional incandescent lamps include coloration of the envelope material itself as well as coating the lamp envelope with materials which diffuse or reflect light. The further conventional mount construction 16 being depicted provides longitudinal alignment of said filament coil 18 in the same direction as the longitudinal direction of a pair of inlead wires 20 and 22 that are connected to each end 24 and 26, respectively, of the filament coil. A central glass member 28 in the depicted mount construction is provided having a flare portion 30 which is sealed directly to a restricted neck portion 32 of the lamp glass envelope 12 at the base of a bulb portion 34 in said envelope. Said glass body 28 is in the form of a hollow tube 36 which includes an inner glass exhaust tube 38 and with said glass body member further including a stem press 40 at the opposite end of said member from flare portion 30 to provide hermetic sealing of the inlead wires 20 and 22 in said lamp. Protruding from the same end of said glass body member 28 as said inlead wires is a glass extension 42 which terminates in a button 44 securing tie wires 46, 48 and 50 in the construction. As depicted, tie wires 46 and 48 provide mechanical rigidity for said inleads whereas tie wire 50 provides central mechanical support of the lamp coil 18.

FIG. 2 depicts a far more simple and economical mount construction 52 made in accordance with the present invention which can be substituted for the conventional mount above described in connection with the prior art incandescent lamp of FIG. 1. Specifically, said improved mount 52 includes a pair of inlead wires 54 and 56 extending upward vertically from stem press seal portion 58 of central glass body member 60 and which in other respects can include the same features above described for this member. The present improvement resides in elimination of all tie wire members since the inlead wires 54 and 56 are formed from dispersion-strengthened copper alloy having a surface metallurgical structure of the fibrous alloy crystals which is essentially devoid of copper matrix metal and which has been nickel-plated in conventional fashion. As can be further noted, said inleads provide the sole means of physical support for a resistive incandescent filament 62 wherein inlead 54 is connected to end 64 of the filament coil and inlead 56 is connected to the other end 66 of said coil. It will also be apparent that the glass extension 68 and button 70 for said glass body member have now become superfluous, as filament support means, hence could be eliminated for even greater simplification ofthe mount construction now being used.

Referring to FIG. 3, a different prior art conventional incandescent lamp is depicted, wherein said lamp 72 has the same general components already described above. In the present lamp embodiment, however, a resistive incandescent filament 74 is supported so that the longitudinal direction of the tungsten coil is transverse with respect to the longitudinal direction of a pair of inlead wires 76 and 78. As can be noted in said present lamp embodiment, one end of said inlead wires 76 and 78 is connected to ends 80 and 82, respectively, of the tungsten coil and with the opposite end of said inlead wires being hermetically sealed at stem press portion 84 of the central glass body member 86 in said mount construction. The present lamp glass envelope 88 includes a bulb portion 90 and a restricted neck portion 92 which is further secured in conventional fashion to base member 94. The glass body member 86 in the present mount construction 96 still further includes glass exhaust tube 98 along with extension 100 and button 102 as hereinbefore mentioned for the FIG. 1 lamp embodiment. Still further, tie wires 104, 106, 108 are provided for mechanical support in the present lamp embodiment as the means of securing needed shock resistance during shipment and use of these products.

The improved glass mount construction 110 depicted in FIG. 4 utilizes inlead wires 112 and 114 made in accordance with the present invention for substitution in the same general lamp configuration above described in connection with FIG. 3. Specifically, said inlead wires 112 and 114 can be constructed from the commerically available dispersion-strengthened copper alloy wire by first removing the customary outer copper metal sheath in a conventional manner and thereafter depositing a customary nickel deposit on the fibrous microstructure of said alloy. Said inleads provide the sole means of physically supporting a resistive incandescent filament 116 as well as providing the electrical connection thereto. The remaining structural configuration of the present mount construction can be the same as previously described in connection with the FIG. 2 mount construction.

In FIG. 5, there is depicted a mount construction made in accordance with the present invention which is suitable for use in electric lamps utilizing a plurality of incandescent filaments which are intended for operation at different levels of illumination. Specifically, said lamps now employ a pair of said lamp filaments for illumination separately or together. A lamp of this type is described in U.S. Pat. No. 3,148,305, also assigned to the present assignee, which obviates need for further description of the general lamp construction beyond the specific improvement made herein with respect to physical support of the individual incandescent filaments being used in this type lamp. Accordingly, the present mount construction 118 can be substituted in electric lamps of this type having a transparent envelope (not shown) which contains said pair of resistive incandescent filaments 120 and 122 each connected to a pair of the conductive inlead wires 124 and 126, respectively, so that each pair of inlead wires is connected to one of said resistive incandescent filaments and with one inlead wire 124' from lead wire pair 124 being connected in common with lead wire 126' from lead wire pair 126 for electrical termination at the same terminal of a lamp base member (also not shown). The remaining inlead wires 124'' and 126'' are connected to separate terminals in said base member in a conventional manner thereby permitting said filaments to be illuminated individually or together. As is further depicted in the present embodiment, the central glass member 130 of said mount construction provides for direct seal at flare portion 132 to said transparent envelope and further provides direct hermetic seal at its opposite end 134 of all inleads in said mount construction. It will also be apparent from inspecting said drawing that central glass body member 130 is again in the form of an outer hollow tube 136 having an inner exhaust 138, all as previously described, and that alignment of the incandescent filaments in said mount construction can either correspond to or be transverse to the longitudinal direction of the inlead wires.

In FIG. 6 there is depicted a different type electric lamp having a sealed outer envelope 142 which contains an inner sealed arc tube 144 along with a resistive incandescent filament 146 as separate illumination sources in said lamp. Said outer transparent lamp envelope 142 can further include a bulb portion 148 along with a restricted neck portion 150 for direct sealing to a disk-like closure element 152 and all of said members can be constructed of glass.

Said disk-like closure member 152 which serves as the base of the depicted lamp construction further provides the only structural support for both illumination sources in the lamp and thereby represents a more simple mount than previously described. Specifically, said composite base-mount 152 includes one pair of the present inlead wires 154 and 156 which are electrically connected to and provide the physical support for sealed arc tube 144 whereas a second pair of said inlead wires 158 and 160 provide comparable suspension of the incandescent filament coil 146. As can be further noted from said drawing, the filament coil 146 is oriented in a transverse direction with respect to the longitudinal direction of its supporting wires and all four inleads are hermetically sealed within said outer glass envelope 142 said novel type lamp construction along with operation of said lamp construction is found in U.S. Pat. Appln. Ser. No. 878,054, now U.S. Pat. No. 4,151,445, filed February 15, 1978, and assigned to the present assignee, so that further description thereon is unnecessary except as pertains to the inlead improvement presently made. Accordingly, all four inleads of said lamp embodiment have a surface metallurgical structure of fibrous dispersion-strengthened copper alloy material and to which can be securely bonded either an outer layer of protective metal such as nickel or aluminum or an outer layer of conventional gettering agents such as zirconium or aluminum metals or non-metallic materials such as phosphorous compounds and the like. The measurement values reported below on said improved inlead wires as used in lamps of the type above described provide still a more detailed understanding of the present invention.

FIG. 7 is a photomicrograph taken at 750X magnification of the fibrous metallurgical structure of the present dispersion strengthened copper alloy inlead having an exterior nickel-plated deposit. Said nickel deposit appears as a thin light-colored film in the photograph and represented a 2% by weight content based on the weight of the unplated inlead wire. The dark specks shown in said photograph represent dispersoid particles of alumina in the fibrous microstructure.

LAMP AND INLEAD TEST RESULTS

Various 100-watt size incandescent lamps utilizing a CC8-type mount configuration were constructed in accordance with the above FIG. 2 embodiment for comparison with lamps utilizing the same mount configuration but which employed dispersion-strengthened copper alloy wire still having a residual outer sheath of the copper matrix metal. Both type inlead constructions were nickel-plated in conventional fashion with various weights of said plating material and the sample lamps thereafter burned for observation of any differences which could be noted in the inlead materials. The observations and results are reported in Table 1 below along with the respective test conditions.

Table 1

| | With Cu Sheath | | | Without Cu Sheath | | |
|---|---|---|---|---|---|---|
| Lamp Group | 1 | 2 | 3 | 4 | 5 | 6 |
| Wt. % Ni plate | 0.5 | 2 | 5 | 0.5 | 2 | 5 |
| Hours Burning Time | | | | | | |
| 2 | Pink | Gray | Gray | Pink | Gray | Gray |
| 4 | Pink | Gray | Gray | Pink | Pink | Gray |
| 8 | Pink | Gray | Gray | Pink | Pink | Gray |
| 16 | Pink | Pink | Gray | Pink | Pink | 9 Gray<br>1 Pink |

The reported coloration in said Table 1 denotes either the original gray color of the nickel plating or a pink color attributed to diffusion of the nickel plating into either the copper matrix metal surface or dispersion-strengthened copper alloy surface therebelow during lamp operation. It can be concluded from said test results that nickel plating diffuses or penetrates into the copper substrate at a much faster rate for the fibrous dispersion-strengthened copper alloy material if said material is devoid of an overlying sheath of the copper matrix metal.

A further series of lamp tests were evaluated using a mechanical drop test for said lamps performed in accordance with test criteria at least comparable to ASTM designation D75F61 (reapproved 1968). Accordingly, 100-watt size incandescent lamps were tested to evaluate the effect upon embrittlement of the tungsten coil which nickel plating can produce if a sufficient amount of nickel migrates from the inleads to the tungsten coil during lamp operation. A comparison was made in this manner between nickel-plated inleads having the fibrous dispersion-strengthened copper alloy surface structure of the present invention and nickel-plated inleads of the same alloy material which still had the conventional copper matrix metal sheath. The drop tests were performed after 16 hours of lamp burning and results are reported in Table 2 below.

Table 2

| Lamp Groups | 7 | 8 | 9 | 10 | 11 | 12 | 13 |
|---|---|---|---|---|---|---|---|
| Wt % Ni Plate | 0 | 0.5 | 2 | 5 | 0.5 | 2 | 5 |
| Cu Sheath | Yes | Yes | Yes | Yes | No | No | No |
| Number of Filament Breaks/Number of Lamps Tested | | | | | | | |
| | 0/10 | 3/10 | 4/10 | 5/10 | 0/10 | 0/10 | 0/10 |
| | 1/10 | 7/10 | 4/10 | 8/10 | 2/10 | 3/10 | 1/10 |
| Total | 1/20 | 10/20 | 8/20 | 13/20 | 2/20 | 3/20 | 2/20 |
| Percent Breaks | 5 | 50 | 40 | 65 | 10 | 15 | 10 |

As can be noted from the filament break results in Table 2, a considerably higher frequency of filament breakage occurs with the copper sheathed inleads and provides clear indication of coil embrittlement caused by nickel migration from the plated inleads.

Further mechanical strength tests were conducted upon 16 mil diameter dispersion-strengthened copper alloy lamp inleads which had been plated with an approximately 2% by weight nickel deposit to determine any loss in mechanical strength resulting from removal of the copper sheath from the commercially available material. Ultimate tensile strength values of 96,070 and 100,120 lbs. per square inch were obtained after sheath removal as compared with values of 103,980 and 101,810 lbs. per square inch for the commercially supplied material. This result indicates no significant loss of mechanical strength in carrying out the present improvement. Further stiffness tests were conducted utilizing the Tinius Olsen tester method described in the aforementioned 4,131,819 patent on the same inlead material and a stiffness number value of 644 obtained for the unsheathed dispersion-strengthened copper alloy material while stiffness number values of 660 and 664 obtained for said inlead material when the sheath was not removed before nickel-plating. It appears from said mechanical strength tests that the benefits achieved in accordance with the present invention are not accompanied by other undesirable results.

From all of the foregoing results, it will be apparent to those skilled in the art that various modifications may be made within the spirit and scope of the present invention. For example, other electric lamp configurations than above specifically disclosed can benefit by incorporation of the presently improved inlead constructions as a substitute for other copper alloy inlead materials now in use. It will also be evident that modifications in the composition of the specific AL20 and DSC 200 commerical inlead materials herein illustrated can be made while still providing the desired metallurgical structure of fibrous dispersion-strengthened copper alloy not having an exterior surface portion of copper metal. Additionally, said surface metallurgical structure can thereafter advantageously be provided with an exterior protective layer or gettering agent and which might also be provided during the wire manufacture. It is intended to limit the present invention, therefore, only by the scope of the following claims.

What we claim as new and desire to secure by Letters Patent of the United States of America is:

1. An electric lamp having a transparent envelope which contains a resistive incandescent filament electrically connected to a pair of conductive inlead wires of dispersion-strengthened copper alloy serving as the sole means of physical support for said resistive incandescent filament, wherein said inlead wires have a surface metallurgical structure of fibrous disperion-strengthened copper alloy.

2. An electric lamp as in claim 1 wherein the inleads have an exterior surface portion of nickel.

3. An electric lamp as in claim 2 wherein the exterior surface portion of nickel is a deposited layer.

4. An electric lamp as in claim 1 wherein the transparent envelope is glass and the inleads are secured thereto with a direct hermetic seal.

5. An electric lamp as in claim 4 wherein said direct hermetic seal for the inleads comprises a glass mount construction being sealed at one end to the glass envelope and terminating at the opposite end in a pressed portion to provide a direct hermetic seal to both inleads.

6. An electric lamp as in claim 5 wherein said glass mount construction is in the form of an outer hollow tube having a flare portion for sealing to the glass envelope and further includes an inner exhaust tube.

7. An electric lamp as in claim 1 wherein the resistive incandescent filament is aligned in the same direction as the longitudinal direction of said inlead wires.

8. An electric lamp as in claim 1 wherein the longitudinal direction of the resistive incandescent direction of said inlead wires.

9. An electric lamp as in claim 4 wherein the glass envelope has a bulb portion along with a restricted neck portion and with said direct hermetic seal of the inleads taking place at said restricted neck portion of the glass envelope.

10. An electric lamp as in claim 4 wherein the glass envelope is a sealed tube and the inleads are hermetically sealed at one end of said tube.

11. An electric lamp having a transparent envelope which contains a pair of resistive incandescent filaments and two pair of conductive inlead wires of dispersion-strengthened copper alloy wires serving as the sole physical support for said resistive incandescent filaments and being connected thereto so that each pair of inlead wires is connected to one of said resistive incandescent filaments and one inlead wire of each pair of inlead wires is connected together in common, wherein said inlead wires have a surface metallurgical structure of fibrous dispersion-strengthened copper alloy.

12. An electric lamp as in claim 11 wherein the transparent envelope is secured to a base member having a plurality of electrical terminals connected to the inlead wires so that one inlead wire from each pair of inlead wires is connected to a separate terminal whereas the common connected inlead wires are also connected to a different separate terminal.

13. An electric lamp as in claim 11 wherein the inlead wires have an exterior surface portion of nickel.

14. An electric lamp as in claim 13 wherein the exterior surface portion of nickel is a deposited layer.

15. An electric lamp as in claim 11 wherein the transparent envelope is glass and the inleads are secured thereto with a direct hermetic seal.

16. An electric lamp as in claim 15 wherein said direct hermetic seal for the inleads comprises a glass mount construction being sealed at one end to the glass envelope and terminating at the opposite end in a pressed portion to provide a direct hermetic seal to both inleads.

17. An electric lamp as in claim 16 wherein said glass mount construction is in the form of an outer hollow tube having a flare portion for sealing to the glass envelope and further includes an inner exhaust tube.

18. An electric lamp as in claim 11 wherein the longitudinal direction of one resistive incandescent filament is transverse with respect to the longitudinal direction of said inlead wires.

19. An electric lamp as in claim 15 wherein the glass envelope has a bulb portion along with a restricted neck portion and with said direct hermetic seal of the inleads taking place at said restricted neck portion of the glass envelope.

20. An electric lamp having an outer transparent envelope which contains at least one resistive incandescent filament and an inner sealed arc tube as separate illumination sources and with each of said illumination sources being connected to a pair of conductive inlead wires of dispersion-strengthened copper alloy serving as the sole means of physical support for said illumination sources, wherein said inlead wires have a surface metallurgical structure of fibrous dispersion-strengthened copper alloy.

21. An electric lamp as in claim 20 wherein the inleads have an exterior surface portion of nickel.

22. An electric lamp as in claim 21 wherein the exterior surface portion of nickel is a deposited layer.

23. An electric lamp as in claim 20 wherein the transparent envelope is glass and the inleads are secured thereto with a direct hermetic seal.

24. An electric lamp as in claim 23 wherein the longitudinal direction of the resistive incandescent filament is transverse with respect to the longitudinal direction of said inlead wires.

25. An electric lamp as in claim 23 wherein the outer glass envelope has a portion along with a restricted neck portion and with said direct hermetic seal of the inleads taking place at said restricted neck portion of the glass envelope.

* * * * *